US006927740B2

(12) United States Patent
Sergi

(10) Patent No.: US 6,927,740 B2
(45) Date of Patent: Aug. 9, 2005

(54) RADIAL PLATE FOR AN ANTENNA

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 5 days.

(21) Appl. No.: 10/429,409

(22) Filed: May 6, 2003

(65) Prior Publication Data

US 2004/0222939 A1 Nov. 11, 2004

(51) Int. Cl.[7] ..... H01Q 1/48
(52) U.S. Cl. ..... 343/830; 343/846; 343/878
(58) Field of Search ..... 343/829, 830, 343/845–849, 878, 905, 906, 890, 892; 174/43, 44, 75 R; 439/902, 916, 581, 578

(56) References Cited

U.S. PATENT DOCUMENTS 2,142,117 A * 1/1939 Dow ..... 343/700 R
2,529,213 A * 11/1950 Goldsmith ..... 343/830
4,623,895 A * 11/1986 Bowering ..... 343/829
5,262,795 A * 11/1993 DeMarre et al. ..... 343/829

* cited by examiner

*Primary Examiner*—Michael C. Wimer
(74) *Attorney, Agent, or Firm*—Renner, Kenner, Greive, Bobak, Taylor & Weber

(57) ABSTRACT

A plate (10) has an opening (14) therein which receives the vertical member (11) of an antenna. A flange (20) is formed on the plate (10), and the vertical member (11) can be attached directly to the flange (20) or can be attached to the flange (20) by a saddle clamp assembly (21). The radial wires (12) of the antenna are carried at the periphery of the polygonal plate (10) by connector assemblies (15). The flange (20) is provided with a coax connector assembly (30) to receive a coax feed line of the antenna so that the radial wires (12) conductively communicate with the feed line.

26 Claims, 2 Drawing Sheets

RADIAL PLATE FOR AN ANTENNA

TECHNICAL FIELD

This invention relates to a plate for carrying the radial wires of an antenna, in particular, a ground-mounted, vertical antenna. More specifically, this invention relates to such a plate which cannot only conveniently and efficiently carry a large number of radial wires, but which also provides the means by which the coax feed line may be conveniently attached to the antenna.

BACKGROUND ART

A vertical antenna, in its simplest form, is electronically equivalent to one-half of a dipole antenna stood on end. When the antenna is mounted close to the ground, the earth below provides the other half of the dipole. Typically, the capacitance between the vertical radiator and the ground causes return currents to flow along the surface of the earth back to the transmitter.

The efficiency of a vertical antenna is greatly improved if wires which extend radially outward from the vertical element of the antenna are used to enhance conductivity. The radial wires may be left on top of the ground, or they may be buried if the antenna is located in a high traffic area. It is preferable to provide as many radial wires as possible, with often times thirty-two or sixty-four wires being employed.

Typically, the radially extending wires are mounted to a circular plate which is carried by, but electrically isolated from, the vertical tower. The feed line, or coax, then must be connected such that its outer braid is attached to the radial wires, and its center core is connected to the vertical tower. The prior art antennas do not provide any convenient manner in which to make these connections, and thus, the antenna installer is left to his own devices.

Moreover, the prior art radial mounting plates are deficient in that where a large number of radial wires are to be utilized, it is difficult to attach them to the plate. Usually, with the conventional circular plates, mounting holes or other devices are provided at the circumferential periphery of the plate. However, unless the plate is of a large diameter, it is difficult to attach a large number of wires at the periphery because they are spaced so close together. Providing a plate with a larger diameter is a possible solution, but not the most desirable solution in that such increases the size of the plate and increases the cost thereof.

DISCLOSURE OF THE INVENTION

It is thus an object of the present invention to provide a plate which is adapted to be carried by the vertical tower of an antenna and which can readily carry the radial wires of the antenna.

It is another object of the present invention to provide a plate, as above, which provides the means by which to render it easy to attach the coax to the radial wires and to the tower.

It is a further object of the present invention to provide a plate, as above, which provides good support for the coax.

It is yet another object of the present invention to provide a plate, as above, which is readily mountable to either a tubular tower portion or a polygonal tower portion.

It is an additional object of the present invention to provide a plate, as above, which is configured so as to maximize the number of radial wires which may be attached thereto.

It is a still further object of the present invention to provide a plate, as above, which permits a facile and more secure attachment of the radial wires to the plate.

These and other objects of the present invention, as well as the advantages thereof over existing prior art forms, which will become apparent from the description to follow, are accomplished by the improvements hereinafter described and claimed.

In general, in accordance with one aspect of the present invention, an apparatus for carrying radial antenna wires for communication with a coax feed line includes a plate having means near the periphery thereof adapted to carry the radial wires. The plate also includes means to receive the coax feed line so that the radial wires may conductively communicate with the coax feed line.

In accordance with another feature of the invention, an apparatus for carrying radial antenna wires is adapted to be carried by a vertical antenna member and includes a plate having an opening therein. The opening is adapted to receive the vertical member therethrough. A flange on the plate is adapted to be attached to the vertical member, and means are formed near the periphery of the plate to carry the radial wires.

In yet another aspect of the invention, an apparatus adapted to be carried by a vertical antenna member and adapted to carry radial antenna wires for connection to a coax feed line includes a plate having an opening therein adapted to receive the vertical member therethrough. A flange on the plate is adapted to be attached to the vertical member. Means are provided near the periphery of the plate to carry the radial wires, and the flange includes means to receive the coax feed line so that the radial wires may conductively communicate with the coax feed line.

An antenna assembly according to the present invention includes a vertically oriented member carrying a plate. A plurality of radially extending wires are carried by the plate. Means are provided on the plate to receive a coax feed line to conductively connect the wires to the feed line.

A preferred exemplary radial wire mounting plate for an antenna incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
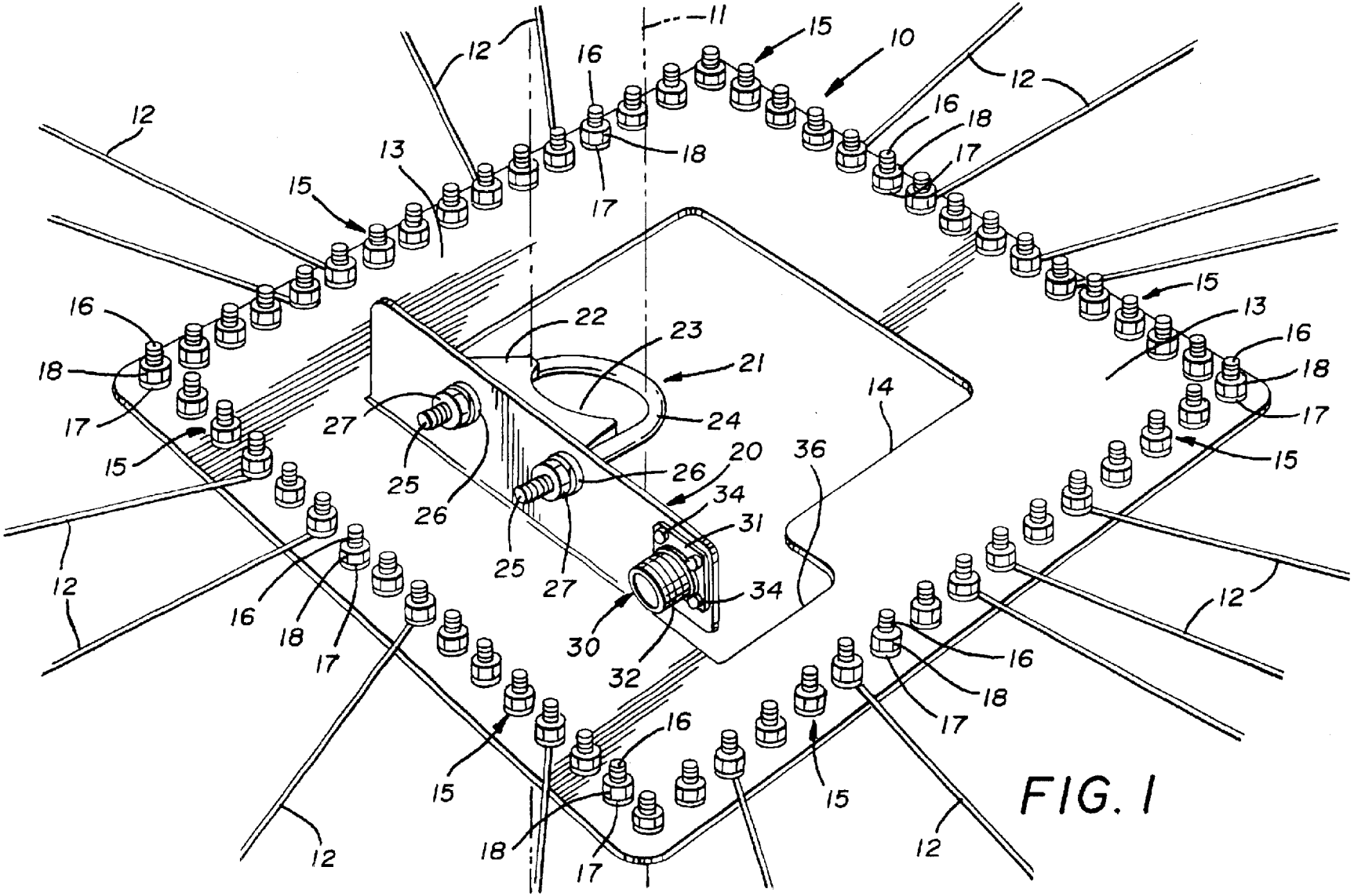
FIG. 1 is a top, front, right side perspective view of a plate made in accordance with the present invention and showing a few radial wires attached thereto.
Figure 2:
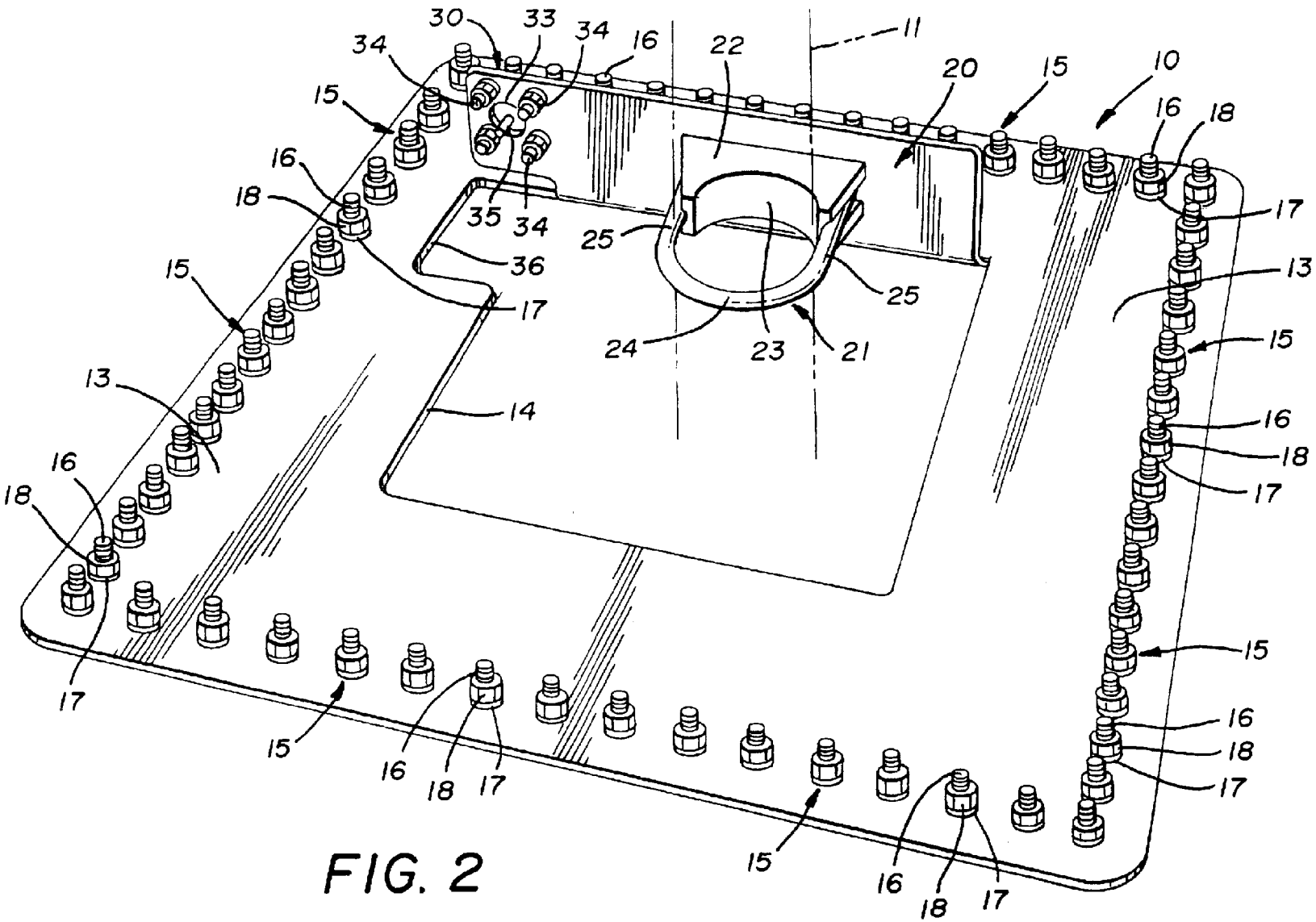
FIG. 2 is a top, rear, left side perspective view of the plate of FIG. 1 but showing no radial wires attached thereto.

A plate made in accordance with the present invention is indicated generally by the numeral 10. Plate 10 is preferably made of a conductive metallic material, such as stainless steel, and is adapted to be attached to the vertical component of an antenna, such as the tube 11 shown in phantom. Plate 10 is also designed to carry a plurality of radial wires 12, some of which are randomly shown in FIG. 1.

Plate 10 includes a flat surface 13 having a cutout opening 14 formed therein. Plate 10 carries a plurality of connector assemblies generally indicated by the numeral 15 and positioned along the periphery of plate 10. Each connector assembly 15 could be as simple as a hole through surface 13 to which the wires 12 may be attached, but preferably includes a stud bolt 16 which is received through one of a plurality of spaced peripheral apertures (not shown) provided through plate surface 13. Each connector assembly 15 also includes at least one washer 17 received around bolt 16, and a nut 18 is provided to hold bolt 16 in place and to affix a wire 12 to assembly 15. Wires 12 are thus electrically connected to plate 10 and may be positioned to extend radially outward from tube 11.

While plate 10 could be of any peripheral configuration, it is preferably polygonal, and still more preferably square, as shown. Such creates a less crowded spacing of connector assemblies 15 at the periphery of plate 10 thereby rendering it easier to gain access to nuts 18. That is, if the same number of connector assemblies are provided on a square plate 10 as opposed to a round plate having a diameter equal to the length of a side of the square, the assemblies would be positioned further apart. As stated above, this not only provides for better access to nuts 18, but also it could allow one to use larger stud bolts 16 thereby providing a stronger connection for the radial wires 12. Alternatively, if one wanted to maintain the same spacing of the connector assemblies 15 on the square plate 10 as that of the same sized round plate, then more connector assemblies 15 could be provided on the square plate 10 than on the round plate.

Plate 10 also includes a mounting flange, generally indicated by the numeral 20, which extends upwardly from surface 13 at a position adjacent to opening 14. Flange 20 enables plate 10 to be attached to the vertical antenna tube 11 by means of an adjustable saddle clamp generally indicated by the numeral 21. Saddle clamp 21 includes a hub or base 22 having a radiused surface 23 and having apertures therethrough (not shown) alignable with apertures (not shown) in flange 20. A U-shaped clamp member 24 has threaded arms 25 which are received through the aligned apertures and which receive washers 26 and nuts 27. With tube 11 extending through opening 14 in plate 10, and being located between clamp member 24 and surface 23 of base 22, the tightening of nuts 27 on the threaded end of arms 25 provides a tight grip on tube 11. Saddle clamp 21 can thus accommodate a range of sizes of tubes 11 which are receivable between radiused surface 23 and clamp member 24.

It should be noted that in actual practice, plate 10 is electrically isolated from the vertical member of the antenna. Thus, if tube 11 were the actual conductive vertical component of the antenna, it would have to be isolated from plate 10, and to that end, a nonconductive sleeve, for example, could be positioned between the conductive tube 11 and saddle clamp 21. Alternatively, tube 11 could merely be a nonconductive stanchion extending from the ground and carrying a conductive vertical member of the antenna.

As a still further alternative, oftentimes the conducting vertical member is carried by a vertically extending, wooden, four-by-four or six-by-six member. By virtue of the configuration of opening 14, plate 10 may also be conveniently attached to such a vertically extending member. That is, as shown, cutout opening 14 is generally square in configuration. As such, if a tube 11 is the element to which plate 10 is to be attached, it can, of course, easily be received through opening 14, as shown. However, if the vertical member is a four-by-four beam, for example, plate 10 can also be readily attached to it. To that end, the beam would pass through opening 14, and instead of using saddle clamp 21, screws or other connecting members can be received through the apertures in flange 20 (otherwise occupied by threaded arms 25) to engage the beam to attach plate 10 to the beam. Thus, plate 10 can be attached to vertical members of a wide variety of configurations.

Flange 20 also carries a coax connector assembly generally indicated by the numeral 30. Assembly 30 includes a plate 31 which carries a threaded nipple connector 32. Plate 31 is attached to flange 20 over an aperture 33 in flange 20 by means of nut and bolt assemblies 34. Nipple connector 32 is provided with a centrally located pin 35 which extends through aperture 33. A coax cable having a conventional attachment adapter formed at the end thereof may be attached to assembly 30 by threading the adapter onto nipple connector 32. Such will automatically electrically connect the outer braid of the coax to plate 10, and thus wires 12, while at the same time the core of the coax is in communication with pin 35. Such readily permits the core of the coax to be attached to the vertical antenna member by extending a wire or other connector from pin 35 to a conductive portion of the vertical member.

It should be noted that coax connector assembly 30 is positioned on flange 20 adjacent to a notched cutout area 36 of plate opening 14. Such is provided so that in the event that the vertical member is a beam which might otherwise fill up opening 14, as previously described, the space adjacent to assembly 30 will always be clear to expose pin 35 for facile attachment to the conductive portion of the vertical member.

In view of the foregoing, it should thus be evident that a plate constructed and utilized as described herein accomplishes the objects of the present invention and otherwise substantially improves the art.

What is claimed is:

1. Apparatus for carrying radial antenna wires for communication with a coax feed line for a vertical member of an antenna, comprising a generally flat plate having a top surface, a bottom surface and a plurality of sides, a plurality of connector means near the periphery of each side of said plate adapted to carry the radial wires, and a flange formed on said plate, said flange being adapted to be attached to the vertical member of the antenna, the vertical member supporting said flange so that the vertical member carries said plate, said flange carrying means to receive the coax feed line so that the radial wires may conductively communicate with the coax feed line.

2. The apparatus of claim 1 wherein said plate is polygonal.

3. The apparatus of claim 2 wherein said connector means include stud members spaced along the sides of said plate.

4. The apparatus according to claim 1 further comprising an opening in said plate adjacent to said flange.

5. The apparatus according to claim 4 wherein said opening is adapted to receive the vertical member of the antenna.

6. The apparatus according to claim 5 wherein the vertical member is a beam and is adapted to be attached to said flange.

7. The apparatus according to claim 5 wherein the vertical member is a tube and further comprising means to attach the tube to said flange.

8. The apparatus according to claim 1 wherein said means to receive includes a nipple connector adapted to receive the coax feed line.

9. Apparatus for carrying radial antenna wires for communication with a coax feed line for a tube of an antenna comprising a plate, connector means near the periphery of said plate adapted to carry the radial wires, said plate including means to receive the coax feed line so that the radial wires may conductively communicate with the coax feed line, and a saddle clamp including a U-clamp having arms extending through and attached to said flange, said clamp being adapted to attach the tube to said flange.

10. The apparatus according to claim 9 wherein said saddle clamp includes a base having a radiused surface, the tube being adapted to be received between said U-clamp and said radiused surface.

11. Apparatus for carrying radial antenna wires and adapted to be carried by a vertical antenna member comprising a plate, an opening in said plate adapted to receive the vertical member therethrough, a flange on said plate, said flange being adapted to be attached to the vertical member, the vertical member supporting said flange so that the vertical member carries said plate, means carried by said flange adapted to be connected to a coax feed line, and connector means near the periphery of said plate adapted to carry the radial wires.

12. The apparatus of claim 11 wherein said plate is polygonal.

13. The apparatus of claim 12 wherein said connector means include stud members spaced along the sides of said plate.

14. The apparatus according to claim 11 wherein the vertical member is a beam and is adapted to be attached directly to said flange.

15. The apparatus according to claim 11 wherein the vertical member is a tube and further comprising means to attach the tube to said flange.

16. Apparatus adapted to be carried by a vertical antenna member and adapted to carry radial antenna wires for connection to a coax feed line comprising a generally flat plate having a top surface, a bottom surface and a plurality of sides, an opening in said plate adapted to receive the vertical member therethrough, a flange on said plate, said flange being adapted to be attached to the vertical member, the vertical member supporting said flange so that the vertical member carries said plate, and a plurality of connector means near the periphery of each side of said plate adapted to carry the radial wires, said flange including means to receive the coax feed line so that the radial wires may conductively communicate with the coax feed line.

17. The apparatus of claim 16 wherein said plate is polygonal.

18. The apparatus according to claim 16 wherein the vertical member is a beam and is adapted to be attached directly to said flange.

19. The apparatus according to claim 16 wherein the vertical member is a tube and further comprising means to attach the tube to said flange.

20. The apparatus according to claim 19 wherein said means to attach includes a saddle clamp including a U-clamp having arms extending through and attached to said flange.

21. The apparatus according to claim 20 wherein said saddle clamp includes a base having a radiused surface, the tube being adapted to be received between said U-clamp and said radiused surface.

22. The apparatus according to claim 16 wherein said means to receive includes a nipple connector adapted to receive the coax feed line.

23. An antenna assembly comprising a generally vertically oriented member, a plate carried by said member, a flange integrally formed with said plate and attached to said member, said member supporting said flange so that said member carries said plate, a plurality of generally radially extending wires carried by said plate, a coax feed line, and means on said flange to receive said feed line to conductively connect said wires to said feed line.

24. The antenna according to claim 23 wherein said plate is polygonal and said wires are connected to said plate near the periphery of said plate at spaced locations therealong.

25. The antenna according to claim 23 further comprising an opening in said plate adjacent to said flange, said vertically oriented member extending through said opening.

26. Apparatus adapted to be carried by a vertical tubular antenna member and adapted to carry radial antenna wires for connection to a coax feed line comprising a generally flat plate, an opening in said plate adapted to receive the vertical tubular member therethrough, a flange on said plate, said flange being adapted to be attached to the vertical member, the vertical tubular member supporting said flange so that the vertical tubular member carries said plate, a clamp having arms extending through and attached to said flange, said clamp attaching said vertical tubular member to said flange, and a plurality of connector means near the periphery of said plate adapted to carry the radial wires, said flange including means to receive the coax feed line so that the radial wires may conductively communicate with the coax feed line.

* * * * *